US006348241B2

(12) United States Patent
Ronge et al.

(10) Patent No.: US 6,348,241 B2
(45) Date of Patent: Feb. 19, 2002

(54) METHOD AND APPARATUS FOR TREATING THE INTERNAL SURFACE OF A GAS BOTTLE

(75) Inventors: Catherine Ronge, Paris; Daniel Boucheron, Chesnay; Roberto Frande, Versailles, all of (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/300,290

(22) Filed: Apr. 27, 1999

(30) Foreign Application Priority Data

Apr. 28, 1998 (FR) ..... 98 05299

(51) Int. Cl.[7] ..... B05D 3/06; C23F 4/02; C21D 9/08

(52) U.S. Cl. ..... 427/554; 427/557; 427/597; 216/94; 134/1; 148/525; 148/565; 148/DIG. 73; 148/DIG. 93

(58) Field of Search ..... 427/497, 596, 427/554, 557, 559; 216/65, 87, 94; 134/1; 148/224, 241, 565, 525, 590, DIG. 73, DIG. 93

(56) References Cited

U.S. PATENT DOCUMENTS

| | | | | |
|---|---|---|---|---|
| 3,450,607 A | * | 6/1969 | Dotson et al. | 427/580 |
| 4,398,966 A | * | 8/1983 | Kelly et al. | 148/565 |
| 4,456,811 A | * | 6/1984 | Hella et al. | 148/565 |
| 4,859,489 A | * | 8/1989 | Pinkhason | 427/580 |
| 4,978,588 A | * | 12/1990 | Adaniya et al. | 427/554 |
| 5,149,935 A | * | 9/1992 | Ozimek et al. | 427/554 |
| 5,449,879 A | * | 9/1995 | Lawson et al. | 148/565 |
| 5,674,328 A | * | 10/1997 | Mannava et al. | 427/596 |
| 6,146,714 A | * | 11/2000 | Beyer et al. | 427/554 |

FOREIGN PATENT DOCUMENTS

| | | | | |
|---|---|---|---|---|
| EP | 0 475 806 A2 | | 3/1992 | |
| FR | 2 688 726 | | 9/1993 | |
| FR | 2 689 423 | | 10/1993 | |
| GB | 2 316 528 A | | 2/1998 | |
| JP | 0189326 | * | 11/1983 | 148/565 |
| JP | 0089711 | * | 5/1984 | 148/565 |
| JP | 0109924 | * | 5/1987 | 148/565 |
| WO | WO 91/11538 | * | 8/1991 | 148/565 |
| WO | WO 93/19888 | | 10/1993 | |
| WO | WO 97/31410 | | 8/1997 | |

OTHER PUBLICATIONS

Translation of French pat. app. #92–04200A1 to Michel et al., 10/93.*

* cited by examiner

*Primary Examiner*—Marianne Padgett
(74) *Attorney, Agent, or Firm*—Burns, Doane, Swecker & Mathis, L.L.P.

(57) ABSTRACT

The method for treating the internal surface of a gas bottle includes the following steps:

a) an incident laser treatment beam is introduced into a bottle through its mouth, approximately along the axis of the bottle;

b) the laser beam is deflected in the bottle onto the internal surface of the bottle;

c) a relative rotation between the bottle and the deflected laser beam is made approximately about the axis of the bottle; and d) a relative displacement between the bottle and the deflected laser beam is made so as to scan most of the internal surface of the bottle with the deflected laser beam.

The apparatus for treating a bottle is designed to implement the steps of the method.

12 Claims, 6 Drawing Sheets

METHOD AND APPARATUS FOR TREATING THE INTERNAL SURFACE OF A GAS BOTTLE

This application claims priority under 35 U.S.C. §§119 and/or 365 to 98 05299 filed in France on Apr. 28, 1998; the entire content of which is hereby incorporated by reference.

BACKGROUND OF THE INVENTION

1. Field of the Invention

The present invention relates to a method and an apparatus for treating the internal surface of a gas bottle. It furthermore relates to a gas bottle whose internal surface has been treated by the method.

2. Description of the Related Art

Bottles intended for storing gases are made of a material, generally a metallic material, which is compatible with the properties of the gas stored.

Current specifications with regard to the in-bottle storage of high-purity gases require very low levels of gaseous or metallic impurities in the bottles. These levels may be as low as several parts per billion, or even parts per trillion, depending on the nature of the gas.

In order to ensure impurity levels as low as possible, it is known to carry out a treatment of the internal surface of the bottle, especially for the purpose of reducing interactions between the gas and the surface. These interactions are in fact sources of contamination of the gas and of degradation of the bottle.

Several techniques for preparing bottles have been used until now. Known techniques include, for example:

- electroneutralization or chemical cleaning, eliminating the active sites on the internal surface, it being possible for this cleaning to be carried out in an ultrasonic bath;
- mechanical polishing (microshot peening, lapping, sandblasting, etc.) and electropolishing, which eliminates the tearing marks and defects;
- chemical deposition or vapour deposition, covering the internal surface of the bottle with a protective layer which is more chemically tailored to the gas; and
- passivation, allowing the wall to be rendered chemically inert.

These preparation techniques are effective at various levels, especially with regard to improving the roughness or the cleanliness, to removing impurities, and to reducing the level of outgassing.

It is possible to achieve high-quality surface finishes using conventional treatment methods. However, to do this it is necessary to increase the number of treatment operations and to combine several methods in order to compensate for the drawbacks resulting from each of them. This results in a high manufacturing cost per bottle and involves lengthy treatment times.

A mechanical polishing technique consists, for example, in microshot peening the internal surface of the bottle.

For this purpose, the bottle is placed vertically, with the mouth pointing downwards. A tube for injecting glass balls and for spraying them is introduced into the bottle along its axis. Since the bottle is rotated about its axis, the glass balls are thrown against the internal surface of the bottle from the end of the tube. The tube is moved axially along the length of the bottle so as to treat the bottle over its entire length.

This polishing technique, as in the other polishing techniques, has the drawback of creating microcavities in the surface of the compressed metal, these being likely to trap impurities which may contaminate the gas contained in the bottle.

Bottle treatments using chemical cleaning entail, in succession, washing operations in acid baths, and then in base baths followed, at each step, by rinsing operations using deionized water, and, finally, a bottle-drying operation. The treatment times may thus amount to several hours per bottle, and consume large quantities of products. These treatments require expensive plants, especially in order to recycle the rinsing water.

Ultrasonic chemical cleaning consists of a succession of immersions of the bottles in baths of various types, in the presence of ultrasound.

The first phase comprises immersing the bottles in a leaching bath based on phosphoric acid at a temperature of 50° C. to 70° C. in the presence of ultrasound.

In a second phase, the bottles are rinsed before being dried in a stream of filtered nitrogen maintained at approximately 60° C.

The rinsing phase includes a first step of two successive immersions in two tanks filled with water.

The bottles are then exposed to trichlorotrifluoroethane.

Document EP-A-0,753,380 describes a method for treating a pressurized-gas container which entails a succession of steps of the type of those mentioned above.

Likewise, document FR-A-1,603,506 describes a method for mechanically shaping the internal surface of hollow components.

Finally, EP-B-0,380,387 describes an apparatus for cleaning a surface using a laser beam. However, this apparatus is only used for surfaces that are easily accessible, because of the use of a hand-held component for pointing the laser beam. Thus, the apparatus cannot be used to treat the inside of a bottle.

The methods described above all have the drawback of introducing new elements on the internal surface of the bottle (for example: silica deposit during microshot peening, traces of acids and of bases) which correspondingly constitute additional impurities. The treatments normally employed by conditioning centres combine a phase of microshot peening with a subsequent treatment phase using perchloroethylene, so as to remove the greases (hydrocarbons) and the deposits left by the microshot peening. Because of the new regulations with regard to solvents, this substance will shortly no longer be able to be used.

The object of the invention is to provide a method and an apparatus for treating the internal surface of a gas bottle, which is easy and quick to implement, while guaranteeing satisfactory treatment of the internal surface of the bottle.

SUMMARY OF THE INVENTION

For this purpose, the subject of the invention is a method for treating the internal surface of a gas bottle, characterized in that it includes the following steps:

a) an incident laser treatment beam is introduced into a bottle through its mouth, approximately along the axis of the bottle;

b) the laser beam is deflected in the bottle onto the internal surface of the bottle;

c) a relative rotation between the bottle and the deflected laser beam is made approximately about the axis of the bottle; and d) a relative displacement between the bottle and the deflected laser beam is made so as to scan most of the internal surface of the bottle with the deflected laser beam.

According to particular modes of implementation, the method includes one or more of the following characteristics:

at step d) of relative displacement between the bottle and the laser beam, two successive scans of most of the internal surface of the bottle are made, the first scan by the laser beam producing an ablation of the surface layer of the internal surface of the bottle, under the action of an athermal shock wave, followed by a second scan by the laser beam producing a thermal effect at the surface of the bottle, resulting in surface remelting of the latter;

the relative displacement comprises a translational relative movement of the deflected laser beam with respect to the bottle approximately along the axis of the bottle;

the relative displacement comprises modifying the angle of deflection of the deflected laser beam with respect to the axis of the bottle;

a cleaning gas is injected into the bottle during the scanning of its internal surface by the deflected laser beam;

the cleaning gas injected into the bottle is continuously sucked out; and an amalgam of protective metals is sprayed onto the point of impact of the deflected laser beam on the bottle.

The subject of the invention is also a gas bottle, characterized in that it has an internal surface treated by the method described above.

The subject of the invention is also an apparatus for treating the internal surface of a gas bottle, characterized in that it includes:

a) means for introducing an incident laser beam inside a bottle through its mouth, approximately along the axis of the bottle;

b) means for deflecting the laser beam in the bottle onto the internal surface of the bottle;

c) means for generating a relative rotation between the bottle and the deflected laser beam approximately about the axis of the bottle; and d) means of relative displacement between the bottle and the deflected laser beam so as to scan most of the internal surface of the bottle with the deflected laser beam.

Depending on particular embodiments, the apparatus includes one or more of the following characteristics:

it includes means for making, during the relative displacement between the bottle and the laser beam, two successive scans of most of the internal surface of the bottle, a first scan by the laser beam producing an ablation of the surface layer of the internal surface of the bottle, under the action of an athermal shock wave, followed by a second scan by the laser beam producing a thermal effect at the surface of the bottle, resulting in surface remelting of the latter;

the said means of relative displacement comprise means of translational relative movement of the deflected laser beam with respect to the bottle approximately along the axis of the bottle;

the said means of relative displacement comprise means for modifying the angle of deflection of the deflected laser beam with respect to the axis of the bottle;

the means for modifying the angle of deflection of the laser beam comprise a prism pivoted about an axis approximately perpendicular to the axis of the bottle, which prism is placed so as to receive the incident beam via an entrance face and to send on the deflected beam via an exit face;

the prism is a triangular-base prism and its third face, complementary to the entrance and exit faces for the laser beam, has a coating with a high reflection coefficient;

the prism is a triangular-base prism and its third face, complementary to the entrance and exit faces for the laser beam, is coupled to a mirror, the reflecting face of which is directed towards the inside of the prism;

the prism is a triangular-base prism and its third face, complementary to the entrance and exit faces for the laser beam, is coupled to a mirror, the reflecting face of which is directed towards the outside of the prism;

it includes means for injecting a cleaning gas into the bottle during the scanning of its internal surface by the deflected laser beam;

it includes means for continuously sucking out the cleaning gas injected into the bottle; and it includes means for spraying an amalgam of protective metals onto the point of impact of the deflected laser beam on the bottle.

BRIEF DESCRIPTION OF THE FIGURES OF THE DRAWING

The invention will be more clearly understood on reading the description which follows, given solely by way of example, and with reference to the drawings in which.

DETAILED DESCRIPTION OF THE PREFERRED EMBODIMENTS

Figure 1:
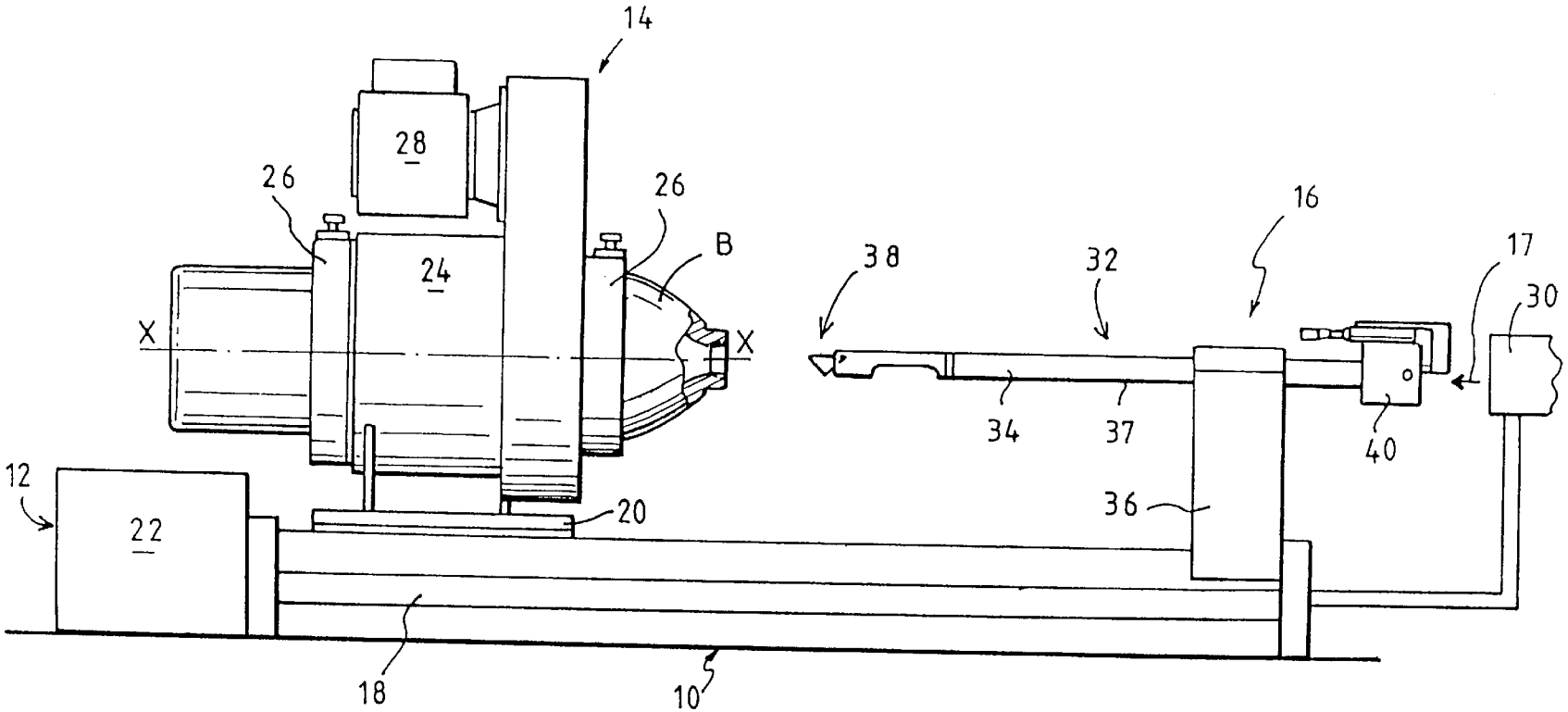
FIG. 1 is a diagrammatic side view of the treatment apparatus according to the invention.

The apparatus for treating gas bottles, shown in FIG. 1, essentially comprises, on a base 10, means 12 of translational movement of a bottle B along its longitudinal axis X—X, means 14 for rotating the bottle about its axis and means 16 for scanning the internal surface of the bottle with a laser treatment beam 17.

The base 10 constitutes a horizontal base plate and has two parallel rails 18. These rails are intended for guiding a carriage 20 for holding the bottle B horizontal and for transporting it.

The means 12 of translational movement comprise a gear-motor set 22 linked to drive means (not shown) suitable for ensuring translational movement of the carriage 20 along the parallel rails 18.

The means 14 for rotating the bottle B about its axis X—X are supported by the carriage 20. They include a drum 24 of horizontal axis inside which the bottle B is mounted so as to rotate. The drum 24 has, at each end, a strap 26 for clamping the bottle so as to ensure that it is driven in rotation.

The rotating part of the drum 24 is connected, via gear means (not shown), to a gear-motor drive unit 28.

The means 16 for scanning with the laser beam include a high-power laser 30, for example an Nd:YAG solid-state laser emitting in the near infrared. Its emission wavelength is 1.064 microns. This laser operates in continuous-wave mode or in pulse mode and is designed to produce 500 mJ pulses at 30 Hz, or even 100 Hz. The diameter of the laser beam is 6 mm.

$CO_2$ gas lasers and excimer lasers may also be used for this type of treatment.

The duration of a pulse can be adjusted between 10 and 30 nanoseconds.

The means 16 furthermore include an optical assembly 32 for guiding and deflecting the laser beam 17 emitted by the laser 30.

This optical assembly 32 includes an optical tube 34 held horizontally along the axis X—X of the bottle by a bracket 36 fixed to the end of the guide rail between the laser 30 and the bottle B.

The optical tube 34 has a cylindrical outer casing 37, defining an axial passage for the laser beam 17. The cylindrical outer casing 37 has an external diameter of 21 mm in order to allow it to be introduced into the mouth of the bottle B, the diameter of which is 22 mm.

The means 16 include, at the laser beam output end, a treatment head 38, called the tube head, supported by one end of the tube 34. The head 38 is shown on a larger scale in FIGS. 2 and 5.

The optical tube 34 has, at its other end via which the laser beam enters, a connection unit 40 for pipes which introduce and exhaust a cleaning gas, which gas also serves for inerting and for the removal of dust particles. This gas flows through the tube 34 as far as the treatment head 38 and thereafter via a set of pipes which will be described with regard to FIG. 2.

Figure 2:
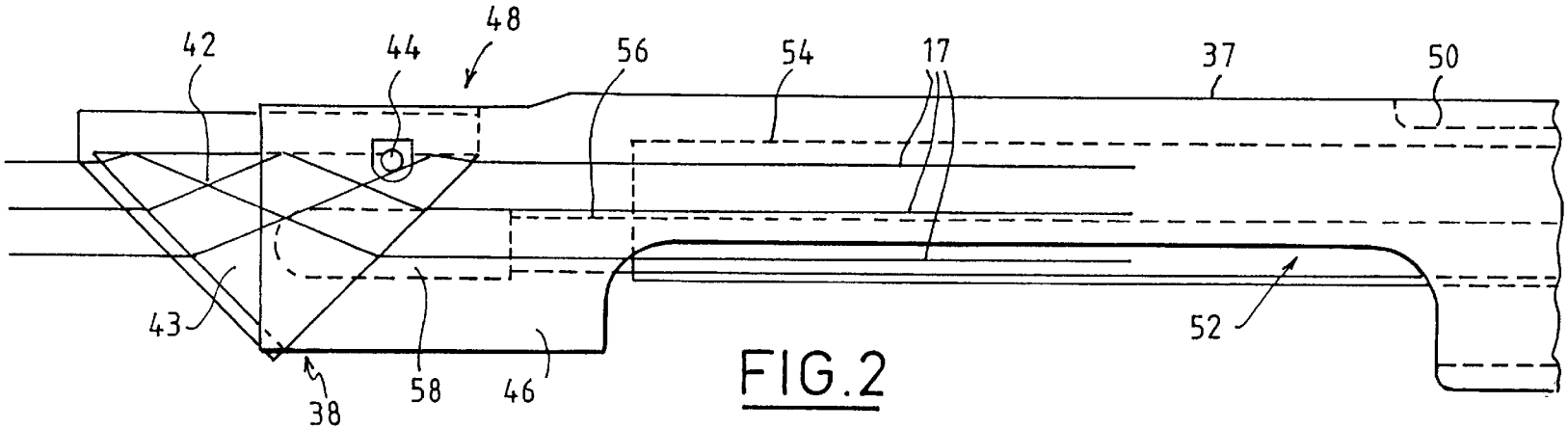
FIG. 2 is a side view on a larger scale of the treatment head of the apparatus in FIG. 1.

The treatment head 38 has, as shown in FIG. 2, an optical deflecting member 42 pivoted to the output end of the tube 34. Various embodiments of the member 42 will be described with regard to the following figures.

This optical member 42 essentially comprises a prism 43 for deflecting the laser beam. The prism is pivoted about a horizontal pin 44 placed transversely to the axis of the tube 34. The pin 44 is supported by two parallel arms 46 on the end of the cylindrical outer casing 37, in the form of a fork 48. Thus, the optical member 42 is housed in the space bounded by the fork 48.

In addition, an actuating rod (not shown) passes through the cylindrical outer casing 37, one end of this rod being connected to the optical deflecting member 42 and the other end of which is connected to an actuating means, for example a cylinder actuator.

The set of pipes for introducing and exhausting the cleaning gas is housed inside the cylindrical outer casing 37 of the optical tube.

This set of pipes includes an exhaust pipe 50, the internal diameter of which is very slightly less than the diameter of the cylindrical outer casing 37. This exhaust pipe 50 terminates in the treatment head a few centimetres to the rear of the optical deflecting member 42. A lower cut-out 52 is provided between the end of the pipe 50 and the optical deflecting member 42. This cut-out is intended for collecting the impurities transported by the cleaning gas.

A first pipe 54 for introducing the cleaning gas to the optical member 42 extends inside the exhaust pipe 50. The pipe 54 extends beyond the end of the pipe 50 and terminates immediately to the rear of the optical deflecting member 42.

The pipe 54 is also designed to conduct the laser beam 17 to the optical deflecting member 42. For this purpose, the pipe 54 has a sufficient diameter for the laser beam 17 to pass through it.

A second feed pipe 56 extends inside the pipe 50 parallel to the first pipe 54. The pipe 56 extends as far as the optical member 42. It terminates in a spray nozzle 58 in a chamber where the gas divides parallel to each lateral face of the optical member 42.

Advantageously, the free cross section of the exhaust pipe 50 is greater than the total of the cross sections of the feed pipes 54 and 56. More specifically, the cross section presented for passage of the gas in the exhaust pipe 50 is greater than the cross section presented for passage of the gas during its introduction into the optical deflecting member 42.

The rear ends of the pipes 50, 54 and 56 are connected to the supply unit 40. The latter includes means for connecting the pipes 54 and 56 to a filtered supply of cleaning gas, advantageously an inert gas, for example nitrogen. The end of the exhaust pipe 50 is connected to a vacuum pump which, by suction, creates a vacuum of 100 mbar in the bottle B.

In the example in FIG. 2, the optical deflecting member 42 consists of a right prism, the base of which consists of a rectangular isoceles triangle. The prism is shown on a larger scale in FIG. 3. It is made of a material having a high index, for example LaSF, the index n of which is equal to 1.82 for a wavelength of 1064 nm.

In the embodiment described, the pivot axis 44 passes through the prism near the hypotenuse close to one of the vertices.

Figure 3:
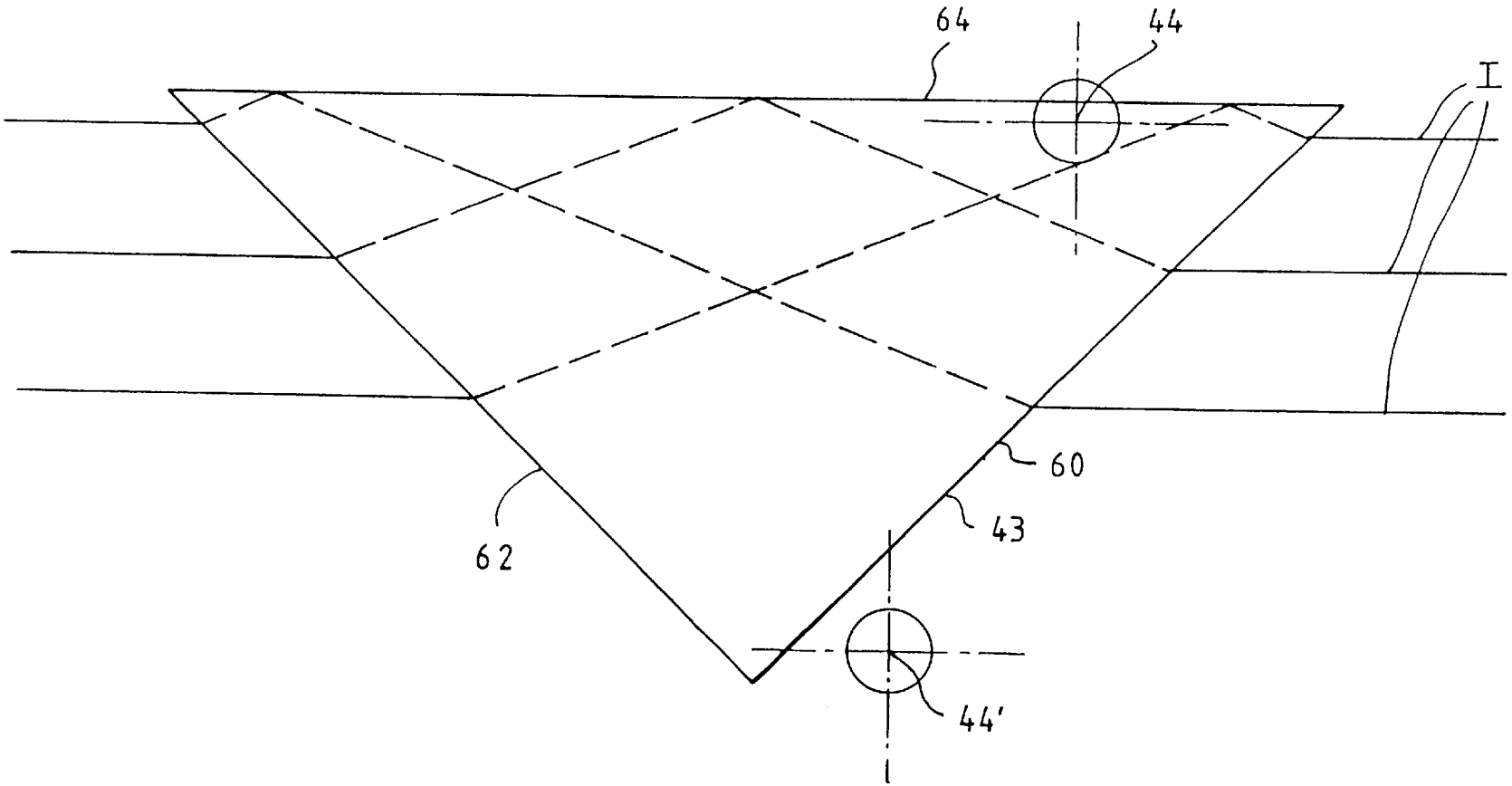
FIG. 3 is a diagrammatic view on a larger scale of the prism of the treatment head in FIG. 2.

As a variant, and as shown in FIG. 3, the pivot axis, denoted by 44', is placed near the right angle and passes outside the prism.

In the embodiment described in FIGS. 1 to 3, the hypotenuse of the prism is covered with a coating having a high reflection coefficient ($R_{max}$), for example a dielectric commercially available from optical equipment suppliers for laser applications.

The other two faces of the prism are covered with an antireflection coating so as to improve the effectiveness of the transmission.

Thus, as shown in FIG. 3, the incident beam enters the prism via an entrance face denoted by 60 and leaves the prism via an exit face 62 after reflection of the hypotenuse, denoted by 64, of the prism.

In this figure, the prism has the hypotenuse placed parallel to the incident laser beam, denoted by I, so that the laser beam undergoes no deflection on passing through the prism, emerging parallel to the incident beam.

Figure 4A:
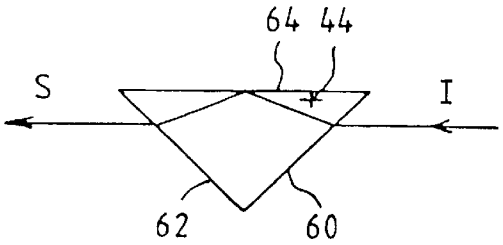
FIGS. 4A, 4B and 4C are diagrammatic views showing the path of a laser beam for various positions of a deflecting prism, one of the faces of which is covered with a coating with a high reflection coefficient.
Figure 4B:
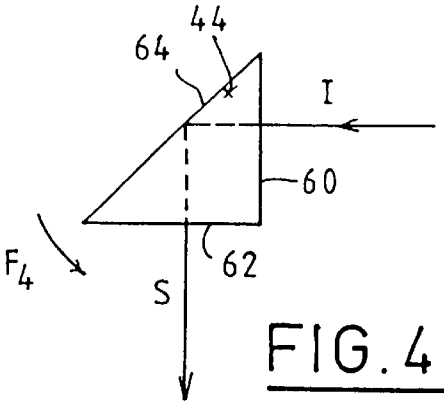
Figure 4C:
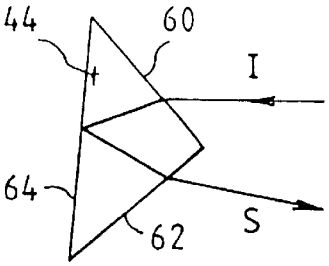

FIGS. 4A to 4C illustrate the deflection of the laser beam in various directions in the plane upon tilting the prism about the pivot axis 44.

In fact, as shown in FIGS. 3 and 4A, the incident beam, denoted by I, emerges in the form of a parallel beam denoted by S, when the hypotenuse of the prism is parallel to the incident beam I.

In FIG. 4B, the prism is inclined at 45° in the direction of the arrow F4 with respect to its position in FIG. 4A, so that the laser beam, after reflection off the hypotenuse, is deflected through an angle of 90°.

When the prism is tilted through an angle exceeding 45°, as shown in FIG. 4C, the laser beam is deflected by an angle greater than 90°. The beams I and S then define an acute angle of less than 90°.

It thus will be understood that the continuous angular offset of the prism makes it possible to provide a continuous deflection of the exiting laser beam and thus provides scanning of the plane perpendicular to the exit face of the prism by means of the deflected laser beam.

The operation of the apparatus will now be described with regard to FIG. 5.

In order to ensure complete treatment of the internal surface of a bottle, the treatment head 38 is inserted into the latter. For this purpose, the tube 34 is partially inserted via the mouth of the bottle along the axis X—X of the latter.

During the treatment, the mouth of the bottle is fitted with a sealing member 70 which is pierced by an opening 72 for passage of the optical tube 34.

Figure 5:
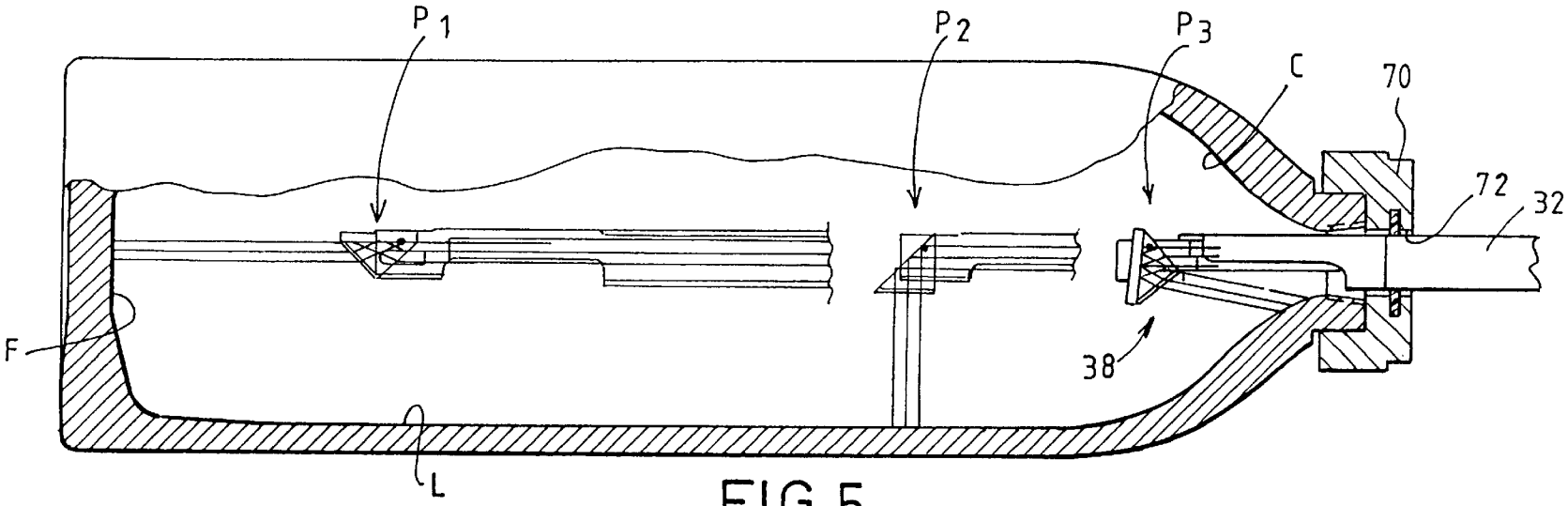
FIG. 5 is a partial longitudinal sectional view of a bottle during treatment, in which the treatment head is shown in three separate positions.

As shown in FIG. 5, the gas bottle comprises essentially three successive parts consisting of a bottom F, a cylindrical side wall L and a neck C extended by the externally threaded mouth of the bottle.

In order to scan the internal surface of the bottle completely, the latter is rotated about its axis of rotation X—X under the action of the drum 24 driven by the gear-motor drive unit 28. Thus, a relative rotational movement is established between the bottle B and the deflected laser beam.

In order to treat the bottom F of the bottle, the prism is initially placed in its position in FIG. 4A, i.e. with the hypotenuse parallel to the incident laser beam. The prism is then in the position denoted by P1 in FIG. 5. In this initial position, the laser beam treats the centre of the bottom F.

The prism is gradually moved angularly, with the bottle still being rotated, so that the end of the deflected beam describes a spiral on the bottom F. The tilting of the prism is carried out sufficiently slowly in order to guarantee complete scanning of the bottom F.

In order to treat the side wall L of the bottle, the prism is placed, tilted through 45°, in its position in FIG. 4B. The deflected beam consequently makes an angle of 90° with the incident beam. With the bottle being rotated and the treatment head being in its intermediate position P2, the bottle is moved translationally at a constant speed along its axis X—X. The deflected laser beam thus scans the side wall L in a helix of constant pitch.

The speed of translational movement of the bottle is chosen so that the pitch of the helix is less than the width of the deflected laser beam.

In order to treat the neck C, the treatment head is placed in the position P3 in the region where the neck C joins the side wall L. The translational movement of the bottle is stopped and only the rotation of the bottle is continued.

In order to scan the neck with the deflected beam, the prism is gradually tilted through an angle greater than 45°, until the deflected beam reaches the mouth of the bottle. The laser beam therefore describes a helix of varying diameter on the neck C.

The treatment is carried out so as to obtain a degree of overlap of the laser impacts possibly up to 10.

The treatment carried out over the entire internal surface consists in ablating the layer of undesirable material with a first pass of the laser beam. The high-power laser, which delivers short laser pulses (a few nanoseconds to a few tens of nanoseconds in duration), with a high peak power (of a few megawatts to a few tens of megawatts), is conducive for making the treatment effective. This is because the oxide layer is subjected to a powerful shock and is ablated, without the surface being heated excessively, since the average power does not exceed a few watts. In this case, a mechanical effect substitutes for a thermal vaporization effect.

Smoothing of the surface is obtained by a second pass, under the same conditions of the laser beam, with the same characteristics. Since the impurities present on the surface have been removed, this second scan by the laser beam produces a thermal effect, resulting in the surface being remelted and therefore being smoothed. This smoothing is carried out until the roughness has been reduced to a submicron scale.

Throughout the treatment of the inside surface of the bottle, inert gas is continuously introduced via the pipes 54 and 56 to the optical deflecting member 42. The inert gas emanating from the pipes 54 and 56 cools and protects the faces of the prism.

The inert gas blown into the bottle is collected via the exhaust pipe 50. The inert gas thus sucked out carries away with it the metal residues and impurities dislodged from the wall during the treatment by the laser beam. These residues and impurities are dust particles generated by the ablation of the oxide layer and of the surface contaminants, for example those coming from the lubricants used in the manufacture of the bottle. Their removal prevents the optical surfaces from being destroyed by discharges from the dust particles in the presence of the high electric-field density of the laser beam.

The 100 mb vacuum created by the vacuum pump ensures that the waste products are reliably removed. In addition, the large relative cross section of the pipe 50 guarantees satisfactory removal.

Figure 6A:
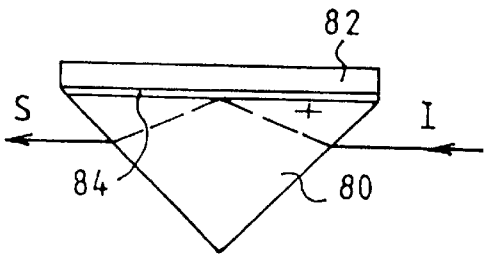
FIGS. 6A, 6B and 6C are diagrammatic views showing the path of a laser beam for various positions of a deflecting prism, one of the faces of which is bonded to the reflecting face of a mirror.
Figure 6B:
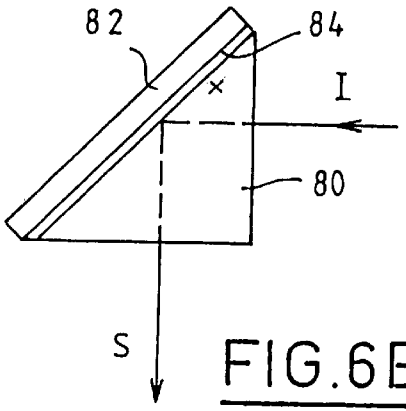
Figure 6C:
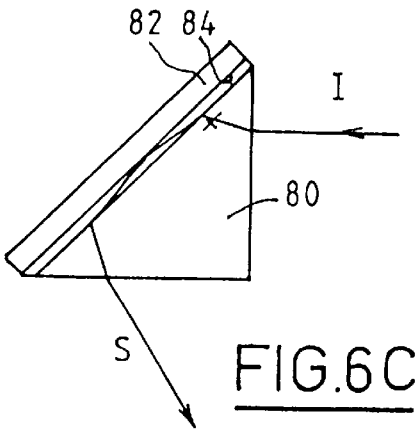

FIGS. 6A to 6C show an alternative embodiment of the optical deflecting member 42. It comprises a prism 80, each of the faces of which is covered with an antireflection coating. A mirror 82 is placed along the hypotenuse of the prism. The single reflecting face 84 of the mirror is applied along the hypotenuse towards the inside of the prism. The mirror is made of a glass of the BK7 type and the reflective coating is a dielectric resistant to the flux used.

Thus, as shown in FIGS. 6A and 6B, for a tilting angle of less than 45°, the laser beam, on passing through the prism, undergoes a deflection in an optical path similar to that of FIGS. 4A and 4B. When the tilting angle of the prism is greater than the limiting angle shown in FIG. 6C, the laser beam entering via the entrance face of the prism exits the prism via the hypotenuse, is reflected off the mirror and re-enters the prism via the hypotenuse, before re-emerging via the exit face. For such angles, the beam is deflected through an angle of greater than 90°, allowing the neck of the bottle to be treated.

FIGS. 7A to 7D show yet another alternative embodiment of the reflection member 42. This comprises a prism 90 on the hypotenuse of which a mirror 92 has been placed. Unlike the embodiment in FIGS. 6A to 6C, the reflecting face 94 of the mirror is opposite the prism 90.

Figure 7A:
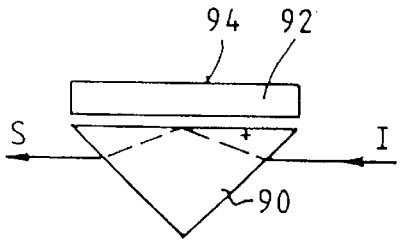
FIGS. 7A, 7B, 7C and 7D are diagrammatic views showing the path of a laser beam for various positions of a deflecting prism, one of the faces of which is occluded by a mirror whose reflecting face is placed opposite the prism.
Figure 7B:
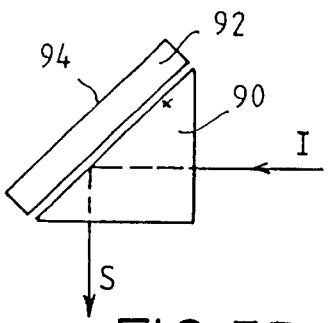

As shown in FIGS. 7A and 7B, for a tilting angle of less than 45°, the optical path of the laser beam is similar to that in FIGS. 4A and 4B.

Figure 7C:
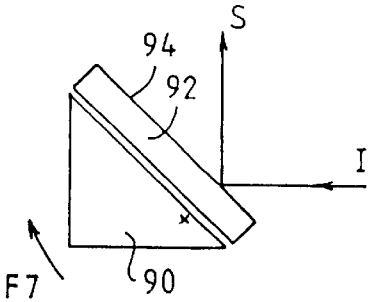
Figure 7D:
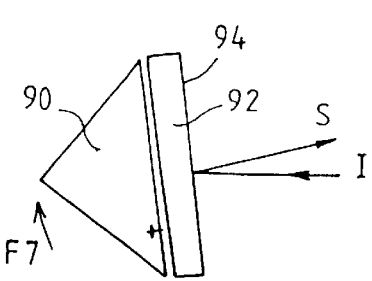
Figure 8A:
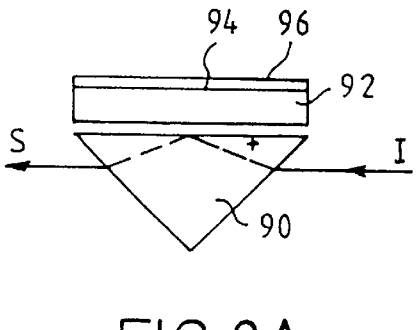
FIGS. 8A, 8B, 8C and 8D are diagrammatic views showing the path of a laser beam for various positions of a deflecting prism combined with a mirror similar to that in FIGS. 7A to 7C and furthermore including a thin film for protecting the reflecting face of the mirror.
Figure 8B:
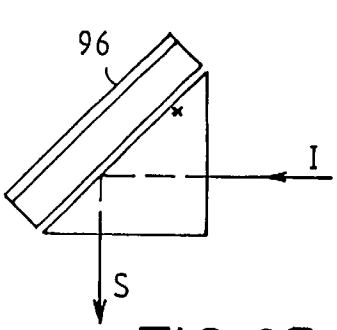
Figure 8C:
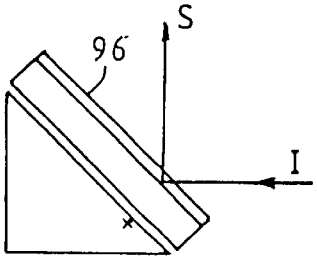
Figure 8D:
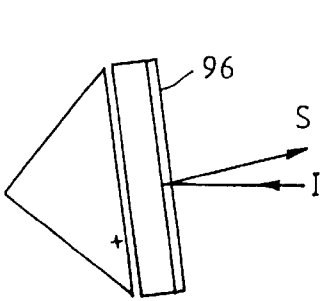

On the other hand, in order to deflect the laser beam through an angle greater than 90°, the prism is tilted in the opposite direction, i.e. in the direction of the arrow F7 in FIGS. 7C and 7D, through an angle of greater than 45° so that the laser beam is deflected, not by the prism, but by that reflecting face 94 of the mirror off which the incident ray is reflected.

The alternative embodiment of the optical deflecting member shown in FIGS. 8A to 8D again has the same components as the optical deflecting member in FIGS. 7A to 7D. However, a thin film, for example made of fused silica (BK7), is applied to the reflecting face 94 of the mirror so as to protect the latter. Such protection may be extended to all the faces of the optical member.

According to yet another alternative embodiment (not shown), the optical deflecting member has a simple mirror pivoted about the axis 44.

Advantageously, in order to improve the overlap of the surfaces successively treated along a generally helical path, an aperture of square cross section is placed between the laser and the optical deflecting member 42. It may be imagined that the square cross section of the laser beam makes it easier to join up the successive turns of the helix.

By way of example, the following parameters are satisfactory for treating the internal surface of steel and light-alloy bottles.

For a steel bottle:
- fluence: 2 J/cm$^2$
- pulse duration: 15 ns
- frequency: 30 Hz
- degree of overlap: 10
- vacuum: 100 mb
- nitrogen flow rates: 0.4 m$^3$/h (via the lateral nozzle 58) and 1.2 m$^3$/h (via the pipe 54)

For a light-alloy bottle:
- fluence: 1.3 J/cm$^2$
- pulse duration: 15 ns
- frequency: 30 Hz
- degree of overlap: 10
- vacuum: 100 mb
- nitrogen flow rates: 0.4 m$^3$/h (via the pipe 56) and 1.2 m$^3$/h (via the pipe 54).

Visual inspection of the surfaces treated according to the invention shows that the treatment is effective. These surfaces are in fact free of rust and have a smooth appearance.

The tests carried out show that the treatment according to the invention on aluminium and steel surfaces results in ablation of the projecting irregularities with a concomitant thermal effect.

Figure 9A:
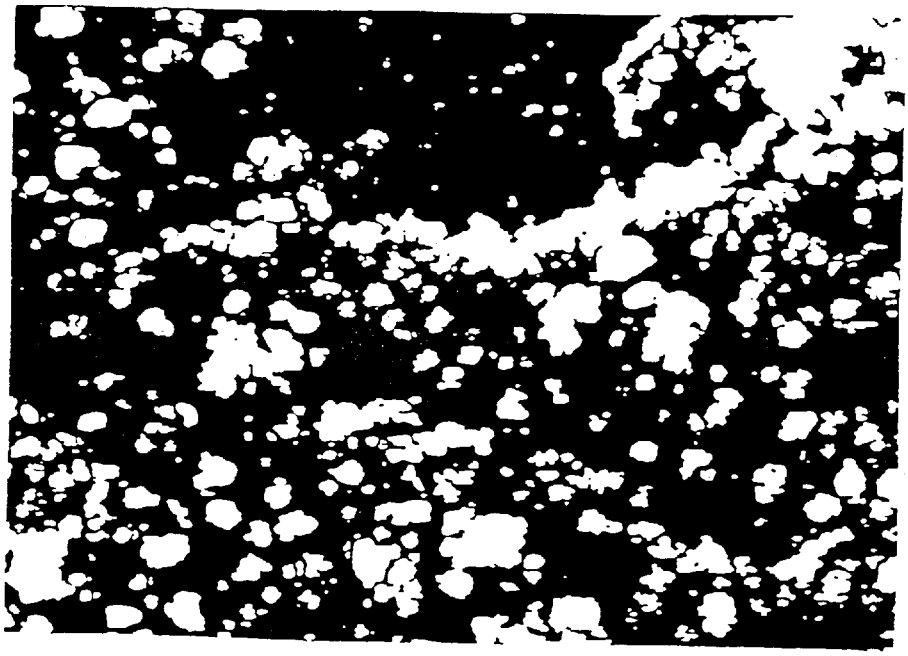
FIGS. 9A and 9B are images produced by a scanning electron microscope of the internal surface of a bottle that has not been treated and has been treated by the method according to the invention, respectively.
Figure 9B:
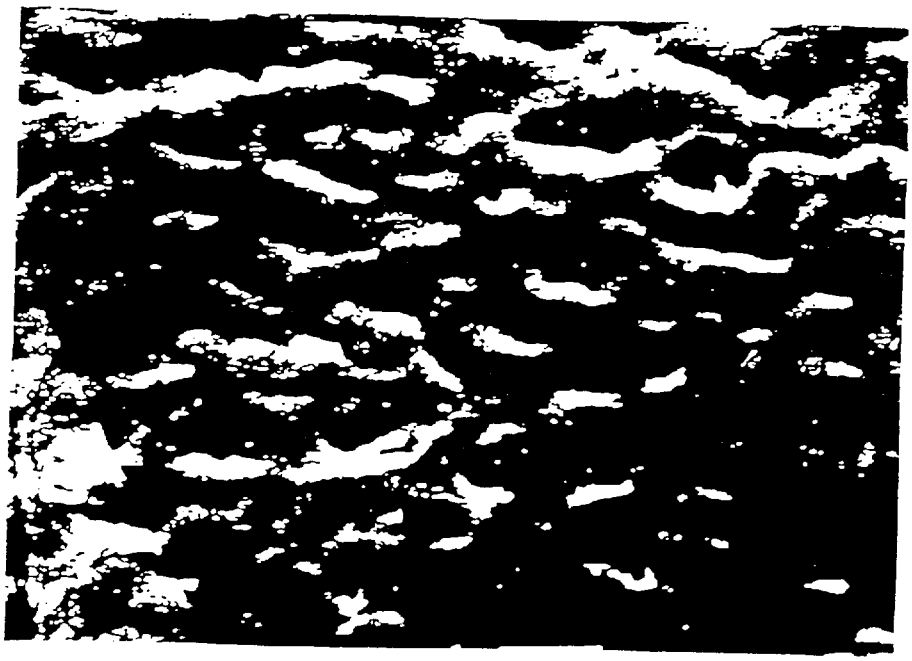

FIGS. 9A and 9B show the surface finishes obtained on the internal surfaces of bottles in the case of an untreated rusty steel (FIG. 9A) and in the case of a steel cleaned by a treatment according to the invention (FIG. 9B). The length of each image corresponds to 90 microns.

FIG. 9A shows a highly irregular surface, the area of the developed surface being very great. In contrast, in the case of FIG. 9B, the surface of the treated steel is more regular.

The consequences of the treatment are as follows:
- removal of surface impurities that have built up during use and storage of the gases, especially C, P, Pb and N in the case of aluminium and Ca and to a lesser degree Si in the case of steels;
- removal of the hydroxide functional groups and hydrocarbons from the steel surfaces; and
- reduction of the oxide layer after treatment.

In the specimen shown in FIG. 9B, the oxide layer has been completely ablated and reveals a completely smooth surface. Roughness measurements (carried out using a Dektak 3030ST apparatus) carried out on specimens removed from the cylindrical body of treated bottles have shown an improvement by a factor of 2, whatever the type of materials used for the bottle (steel or aluminium).

The treatment according to the invention smooths the surface and removes the surface defects on a scale of less than one micrometer. This improvement in the surface finish to a submicron scale could not be demonstrated because of the low resolution of the roughness meters currently available.

Moreover, an untreated surface and a surface that has undergone a treatment according to the invention were etched using nitric acid. The treated specimens are etched at a few preferential sites whereas, in the case of the untreated specimens, the etching is more homogeneous over the entire surface. In addition, the corrosion rate has been markedly reduced in the case of the treated surface.

Thus, the surface treatment according to the invention exhibits surface cleaning, smoothing and passivation properties. In particular, the number of residual particles is less than 10 particles with a diameter of greater than 0.2 microns in a volume of 27 liters.

Such a treatment is particularly suitable for bottles intended for transporting and storing ultrapure gases, calibration mixtures or special gases for the semiconductor industry.

Moreover, as a variant, means are provided, on the end of the tube which goes into the bottle, which spray an amalgam of noble metals onto the focal spot of the very-high-power laser. Thus, while the internal surface of the bottle is being scanned, a surface alloy is deposited which gives the bottle good corrosion-resistance properties.

The treatment method described here, using two successive treatment phases—a first producing ablation under the action of an athermal shock, followed by a second producing a thermal effect resulting in surface remelting—may be implemented by any suitable means, and especially by means other than an optical member for deflecting a laser beam.

What is claimed is:

1. Method for treating the internal surface of a gas bottle, comprising the steps of:

a) introducing an incident laser treatment beam into the bottle through a mouth of the bottle, approximately along the axis of the bottle, wherein the laser beam has a wavelength in the near infrared;

b) deflecting the laser beam in the bottle onto the internal surface of the bottle;

c) generating a relative rotation between the bottle and the deflected laser beam approximately about the axis of the bottle; and d) generating a relative displacement between the bottle and the deflected laser beam, wherein two successive scans of most of the internal surface of the bottle are made, a first scan by the laser beam producing an ablation of a surface layer of the internal surface of the bottle, under an action of a shock wave, followed by a second scan by the laser beam producing a thermal effect at the surface of the bottle, resulting in a remelting of the internal surface.

2. Method according to claim 1, wherein the relative displacement comprises a translational relative movement of the deflected laser beam with respect to the bottle approximately along the axis of the bottle.

3. Method according to claim 1, wherein the relative displacement comprises modifying an angle of deflection of the deflected laser beam with respect to the axis of the bottle.

4. Method according to claim 1, wherein a cleaning gas is injected into the bottle during the scanning of the internal surface of the bottle by the deflected laser beam.

5. Method according to claim 4, wherein the cleaning gas injected into the bottle is continuously sucked out.

6. Method according to claim 1, wherein the relative displacement comprises a translational relative movement of the deflected laser beam with respect to the bottle approximately along the axis of the bottle.

7. Method according to claim 1, wherein the relative displacement comprises modifying an angle of deflection of the deflected laser beam with respect to the axis of the bottle.

8. Method according to claim 1, wherein a cleaning gas is injected into the bottle during the scanning of the internal surface of the bottle by the deflected laser beam.

9. Method according to claim 1, wherein the remelting of the internal surface reduces the roughness of the internal surface to a submicron scale.

10. Method for treating the internal surface of a gas bottle, comprising the steps of:

a) introducing an incident laser treatment beam into the bottle through a mouth of the bottle, approximately along the axis of the bottle, wherein the laser beam has a wavelength in the near infrared;

b) deflecting the laser beam in the bottle onto the internal surface of the bottle;

c) generating a relative rotation between the bottle and the deflected laser beam approximately about the axis of the bottle; and d) generating a relative displacement between the bottle and the deflected laser beam, wherein an amalgam of metals is projected onto a point of impact of the deflected laser beam on the bottle.

11. Method for treating the internal surface of a gas bottle, comprising the steps of:

a) introducing an incident laser treatment beam into the bottle through a mouth of the bottle, approximately along the axis of the bottle, wherein the laser beam has a wavelength in the near infrared;

b) deflecting the laser beam in the bottle onto the internal surface of the bottle;

c) generating a relative rotation between the bottle and the deflected laser beam approximately about the axis of the bottle;

d) generating a relative displacement between the bottle and the deflected laser beam;

e) scanning the internal surface with the laser beam, thereby producing an ablation of a surface layer of the internal surface of the bottle, under an action of a shock wave; and f) scanning the internal surface with the laser beam, thereby producing a thermal effect at the surface of the bottle, resulting in a melting of the internal surface.

12. Method according to claim 11, wherein the melting of the internal surface reduces a roughness of the internal surface to a submicron scale.

* * * * *